US008893791B2

(12) United States Patent
Crow et al.

(10) Patent No.: US 8,893,791 B2
(45) Date of Patent: Nov. 25, 2014

(54) MULTI-POSITION MECHANICAL SPEAR FOR MULTIPLE TENSION CUTS WITH RELEASABLE LOCKING FEATURE

(75) Inventors: Stephen L. Crow, Kingwood, TX (US); Christopher W. Guidry, Spring, TX (US); William A. Hered, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 246 days.

(21) Appl. No.: 13/222,125

(22) Filed: Aug. 31, 2011

(65) Prior Publication Data

US 2013/0048268 A1 Feb. 28, 2013

(51) Int. Cl.
*E21B 29/00* (2006.01)
*E21B 31/16* (2006.01)

(52) U.S. Cl.
CPC ..... *E21B 31/16* (2013.01)
USPC ..... 166/298; 166/55.7

(58) Field of Classification Search
CPC ..... E21B 29/002; E21B 29/00; E21B 29/005; E21B 31/16
USPC ..... 166/55.7, 298, 55.8
See application file for complete search history.

(56) References Cited

U.S. PATENT DOCUMENTS 1,638,494 A * 8/1927 Lewis et al. ..... 294/86.15
1,867,289 A 7/1932 Ventresca
2,203,011 A 6/1940 Ellis et al.
2,899,000 A 8/1959 Medders et al.
2,991,834 A 7/1961 Kennard
3,399,729 A * 9/1968 McGill ..... 166/120
4,047,568 A 9/1977 Aulenbacher
4,071,084 A * 1/1978 Brown et al. ..... 166/129
4,610,300 A * 9/1986 Mullins et al. ..... 166/134
4,709,758 A 12/1987 Preston, Jr.

(Continued)

FOREIGN PATENT DOCUMENTS

WO 9205336 A1 4/1992
WO 03101656 A1 12/2003
WO 2011031164 A1 3/2011

OTHER PUBLICATIONS

Baker Hughes technical information, Baker Oil Tools, Convention Fishing Technical Unit, "Casing and Tubing Spear Packoff Assembly", Oct. 2003, 1-8.

(Continued)

*Primary Examiner* — Jennifer H Gay
*Assistant Examiner* — George Gray
(74) *Attorney, Agent, or Firm* — Steve Rosenblatt

(57) ABSTRACT

A cut-and-pull spear is configured to obtain multiple grips in a tubular to be cut in tension. A lock feature holds the set position of the slips and seal. The lock can be defeated with an axial force that retracts a spring-loaded dog, and the lock can be reset to the run-in position, with the slips and seal retracted, so that the assembly can be repositioned in the same trip for another cut. A cam surface prevents setting the slips and seal until the spear is relocated to the next desired cut location or removed from the wellbore. The lock can be defeated with picking up or with a pressuring up on a dropped ball for an emergency release. A surface signal of the release is provided by a stack of disc springs that have to be compressed to release the lock.

38 Claims, 17 Drawing Sheets

(56) References Cited

U.S. PATENT DOCUMENTS

| | | | | |
|---|---|---|---|---|
| 4,969,514 | A | 11/1990 | Morris et al. | |
| 5,086,839 | A | 2/1992 | Setterberg, Jr. et al. | |
| 5,101,895 | A | 4/1992 | Gilbert | |
| 5,253,710 | A | 10/1993 | Carter et al. | |
| 6,176,311 | B1 | 1/2001 | Ryan | |
| 6,276,452 | B1 | 8/2001 | Davis et al. | |
| 6,357,528 | B1 | 3/2002 | Davis et al. | |
| 6,607,031 | B2 | 8/2003 | Lynde et al. | |
| 6,655,461 | B2 * | 12/2003 | Eslinger et al. | 166/305.1 |
| 7,562,700 | B2 | 7/2009 | Lewis et al. | |
| 7,610,957 | B2 | 11/2009 | Davis et al. | |
| 7,762,330 | B2 | 7/2010 | Saylor, III et al. | |
| 7,779,901 | B2 | 8/2010 | Davis et al. | |
| 2005/0077046 | A1 | 4/2005 | Simpson et al. | |
| 2005/0126775 | A1 | 6/2005 | Van Nguy et al. | |
| 2006/0196679 | A1 | 9/2006 | Brisco et al. | |
| 2007/0131410 | A1 | 6/2007 | Hill et al. | |
| 2010/0288491 | A1 | 11/2010 | Cochran et al. | |
| 2012/0285684 | A1 * | 11/2012 | Crow et al. | 166/298 |
| 2012/0292027 | A1 * | 11/2012 | Crow et al. | 166/297 |
| 2012/0292028 | A1 * | 11/2012 | Crow et al. | 166/297 |

OTHER PUBLICATIONS

Excerpt: Baker Hughes "Wellbore Intervention" catalog, 2010, 3pp.

* cited by examiner

MULTI-POSITION MECHANICAL SPEAR FOR MULTIPLE TENSION CUTS WITH RELEASABLE LOCKING FEATURE

FIELD OF THE INVENTION

The field of the invention is tubular cutters that grip before the cut to put the string in tension, more particularly, a resettable tool with the ability to isolate the tubular with a seal by closing a seal bypass while leaving the bypass open for circulation as the tubular is cut.

BACKGROUND OF THE INVENTION

When cutting and removing casing or tubulars, a rotary cutter is employed that is driven from the surface or downhole with a downhole motor. The cutting operation generates some debris and requires circulation of fluid for cooling and, to a lesser extent, debris removal purposes. One way to accommodate the need for circulation is to avoid sealing the tubular above the cutter as the cut is being made. In these cases also the tubular being cut can be in compression due to its own weight. Having the tubing in compression is not desirable as it can impede the cutting process making blade rotation more difficult as the cut progresses. Not actuating a seal until the cut is made (as shown in U.S. Pat. No. 5,101,895), in order to allow for circulation during the cut, leaves the well open so that if a kick occurs during the tubing cutting it becomes difficult to quickly get control of the well. Not gripping the cut casing until the cut is made, so that the cut is made with the tubular in compression, is shown in U.S. Pat. No. 6,357,528. In that tool there is circulation through the tool during cutting followed by the dropping of an object into the tool to allow the tool to be pressured up, so that the spear can be set after the cut is made.

Sometimes the casing or tubular is cut in a region where it is cemented, so that the portion above the cut cannot be removed. In these situations another cut has to be made further up or down the casing or tubular. Some known designs are set to engage for support with body lock rings. In this case, there is but a single opportunity to deploy the tool in one trip. In the event the casing or tubular will not release, these tools have to be pulled from the wellbore and redressed for another trip.

While it is advantageous to have the opportunity for well control in the event of a kick, the setting of a tubular isolator has in the past presented the associated problem of blocking fluid circulation as the cut is being made.

Another approach to making multiple cuts is to have multiple assemblies at predetermined spacing so that different cutters can be sequentially deployed. This design is shown in U.S. Pat. No. 7,762,330. It has the ability to sequentially cut and then grip two cut pieces of a tubular in a single trip, and then remove the cut segments together.

U.S. Pat. No. 5,253,710 illustrates a hydraulically actuated grapple that puts the tubular to be cut in tension so that the cut can be made. U.S. Pat. No. 4,047,568 shows gripping the tubular after the cut. Neither of the prior two references provide any well control capability.

Some designs set an inflatable packer, but only after the cut is made, so that there is no well control as the cut is undertaken. Other designs are limited by being settable only one time, so that, if the casing will not release where cut, making another cut requires a trip out of the well. Some designs set a packer against the stuck portion of the tubular as the resistive force. This method puts the tubular being cut in compression and makes cutting more difficult. Some designs use a stop ring which requires advance spacing of the cutter blades to the stop ring. In essence, the stop ring is stopped by the top of a fish so that if the fish will not release when cut in that one location, the tool has to be tripped out and reconfigured for a cut at a different location.

The latter design is illustrated in FIG. 1. The cutter (that is not shown) is attached at thread 10 to bottom sub 12. Mandrel 14 connects drive hub 16 to the bottom sub 12. Stop ring 18 stops forward travel when it lands on the top of the fish (that is also not shown). When that happens, weight is set down to engage castellations 20 with castellations 22 to rotate a cam assembly 24 such that a stop to travel of the cone 26 with respect to slips 28 can be moved out of the way. A subsequent pickup force will allow the cone 26 to go under the slips 28, which will grab the fish and hold it in tension while the cut is made. Again, the cut location is always at a single fixed distance to the location of the stop ring 18.

Some designs allow a grip in the tubular to pull tension without the use of a stop ring but they can only be set one time at one location. Some examples are U.S. Pat. Nos. 1,867,289; 2,203,011 and 2,991,834. U.S. Pat. No. 2,899,000 illustrates a multiple row cutter that is hydraulically actuated while leaving the mandrel open for circulation during cutting.

A more recent example of a tubular cutter is found in WO2011/031164 and uses spaced slips about a sealing element for a tubular cutting tool. It has more limited functionality than the present invention, especially with regard to cutting-in-tension and providing well control if there is a well kick.

What is needed and provided by the present invention is the ability to make multiple cuts in a single trip while providing a spear that is mechanically set to grab above the cut location inside the tubular being cut. Additionally, the packer can be deployed before the cut is started, in order to provide well control and bypass-circulation through the tool during the cut, so other downhole equipment can also be operated. The tubular to be removed is engaged before the cut and put in tension while the cut is taking place. To those skilled in the art, these and other features of the present invention will be more apparent from a review of the detailed description and the associated drawings. It should be understood that the full scope of the invention is to be determined from the appended claims.

SUMMARY OF THE INVENTION

A cut-and-pull spear is configured to obtain multiple grips in a tubular to be cut under tension. The slips are set mechanically with the aid of drag blocks to hold a portion of the assembly while a mandrel is manipulated. An annular seal is set in conjunction with the slips to provide well control during the cut. An internal bypass around the seal can be in the open position to allow circulation during the cut. With mechanical manipulation, the bypass can be closed to control a well kick. The seal remains set. If the tubular will not release after an initial cut, the spear can be triggered to release and be reset at another location. The mandrel is open to circulation while the slips and seal are set and the cut is being made. Cuttings are filtered to prevent them from entering the bypass and migrating to the blowout preventers. A lock feature holds the set position of the slips and seal. The lock can be defeated with an axial force that retracts a spring-loaded dog, and the lock can be reset to the run-in position with the slips and seal retracted so that the assembly can be repositioned in the same trip for another cut. A cam surface prevents setting the slips and seal until it is overcome after relocation of the tool to the next desired cut location or for removal from the wellbore. The lock can be defeated either by picking up or by pressuring up on a dropped ball for an emergency release. A surface signal of the release is provided by a load-biasing member or a plurality of such members that have to be overcome to release the lock.

DETAILED DESCRIPTION OF THE PREFERRED EMBODIMENT

Figure 3:
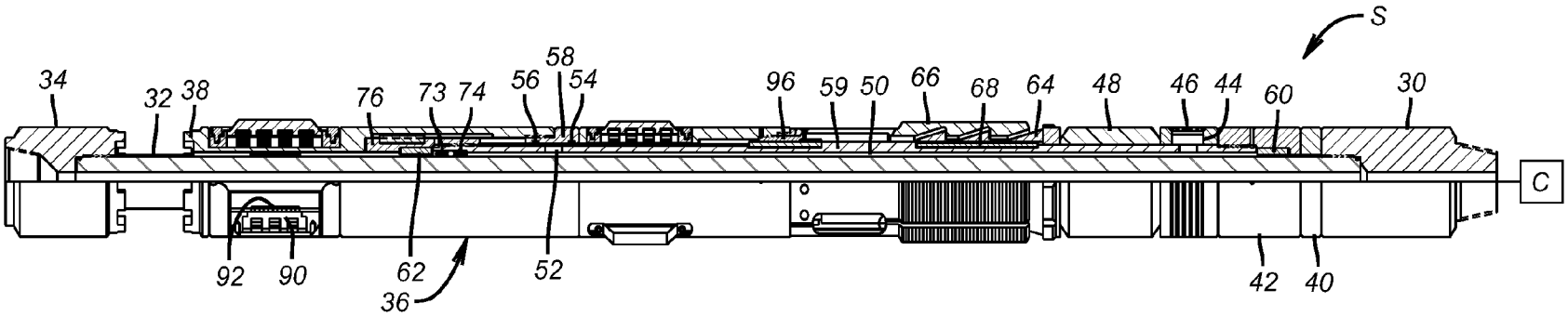
FIG. 3 is an alternative embodiment of the cut-and-pull spear with the annular seal and the bypass for the seal in the closed position.

Referring to FIG. 3, the spear S has a bottom sub 30 to which the cutter, schematically illustrated as C, is attached for tandem rotation. An inner mandrel 32 connects the bottom sub to the drive sub 34. An outer subassembly 36 extends from castellations 38 at the top end to the bearing 40 at the lower end. Bearing 40 is used because the bottom sub 30 will turn as a casing or tubular (not shown) is cut while sub 42 is stationary. Above the sub 42 are ports 44 covered by preferably a wire wrap screen 46. Other filtration devices for capturing cuttings when the tubular is cut are envisioned. A debris catcher can also be located below the bottom sub 30 to channel the return fluid flowing through the cutter C and back toward the surface from the region where the cutter C is operating. A variety of known rotary cutter designs can be used with the potential need to modify them for a flow-through design to enable cuttings/debris removal. Several known debris catcher designs can be used such as those shown in U.S. Pat. Nos. 6,176,311; 6,276,452; 6,607,031; 7,779,901 and 7,610,957 with or without the seal 48. While the seal 48 is preferably an annular shape that is axially compressed to a sealing position, alternative designs with a debris catcher can involve a diverter for the debris laden fluid that either does not fully seal or that seals in one direction, such as a packer cup. Alternatively, a debris catcher with a diverter can be used in conjunction with a seal, such as 48, while operating with the bypass 50 in the open position.

Ports 44 lead to an annular space 50 that extends to ports 52 which are shown as closed in FIG. 3 because the o-rings 54 and 56 on sub 58 straddle the ports 52. An outer mandrel 59 extends between bearings 60 and 62 and envelops the inner mandrel 32. Outer mandrel 59 supports the seal 48, the cone 64, and the slips 66. A key 68 locks the cone 64 to the outer mandrel 59. Outer mandrel 59 only turns slightly. Slips 66 are preferably segments with multiple drive ramps such as 70 and 72 that engage similarly sloped surfaces on the cone 64 to drive out the slips 66 evenly and distribute the reaction load from them when they are set. Outer mandrel 59 has chevron seals 73 and 74 near its upper end adjacent to bearing 62 to seal against the rotating inner mandrel 32. End cap 76 is secured to outer mandrel 59 while providing support to the bearing 62. A key 78 in end cap 76 extends into a longitudinal groove 80 in top sub 82. Top sub 82 is threaded at 84 to sub 58 for tandem axial movement without rotation.

Figure 4:
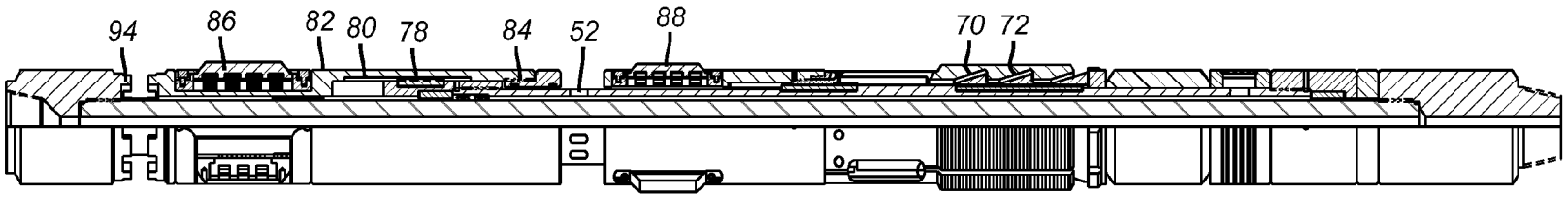
FIG. 4 is a view of FIG. 3 with the bypass for the seal shown in the open position.
Figure 5A:
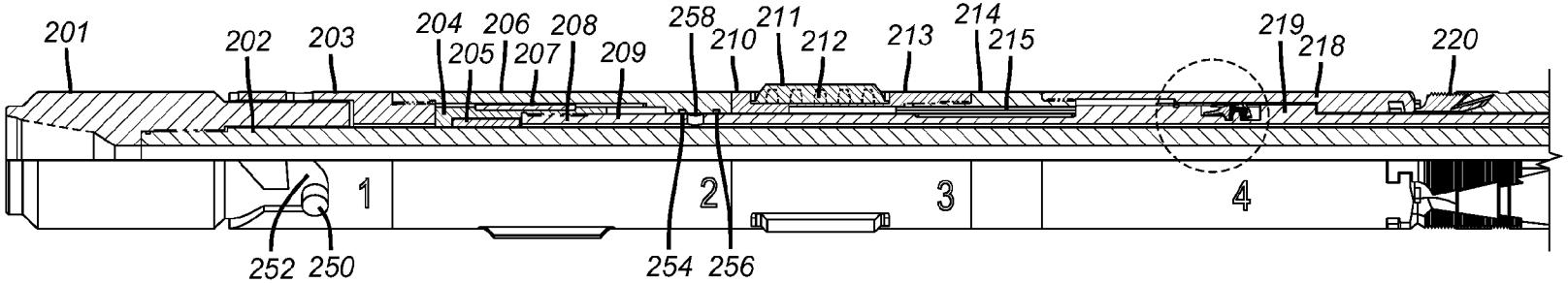
FIG. 5*a*-5*b* is a section view of an alternative and preferred embodiment using the releasable locking feature and shown in the run-in position.
Figure 6:
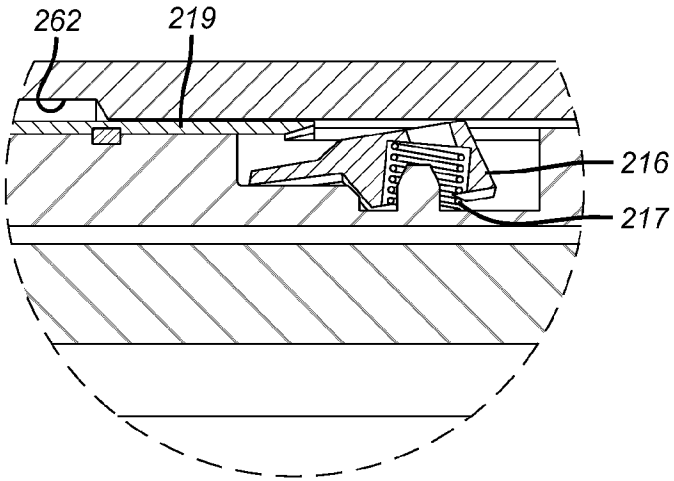
FIG. 6 is a detailed view of the lock shown in the defeated position during deployment.
Figure 5B:
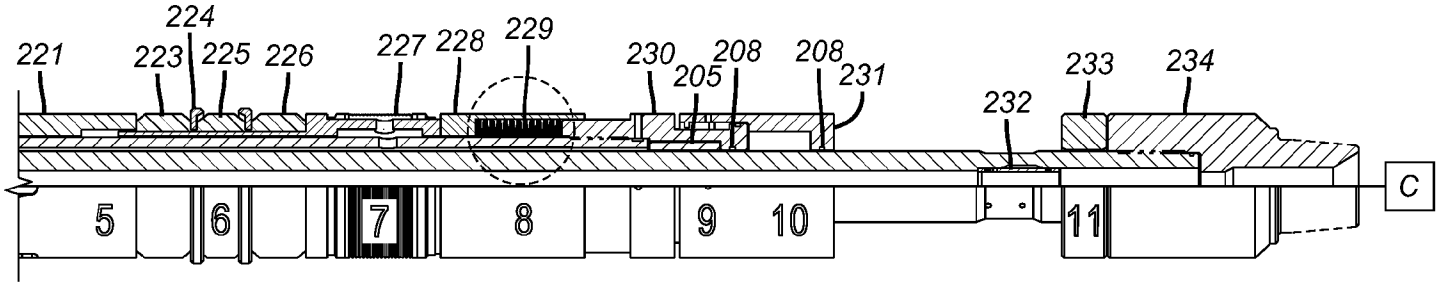
Figure 7:
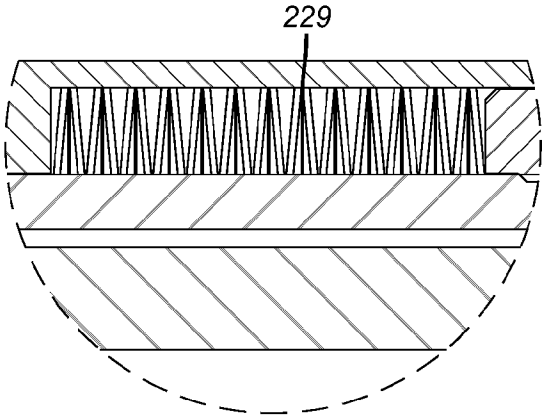
FIG. 7 shows a detail of the stack of disc springs that are compressed to allow the lock of FIG. 6 to achieve the locked position after the slips and sealing element are set.

Upper drag block segments 86 and lower drag block segments 88 hold the outer non-rotating assembly fixed against an applied force so that mechanical manipulation of the inner mandrel 32 can actuate the spear S as will be subsequently described. In between the spaced drag block segments 86 is an automatic nut 90 feature that consists of a series of spaced segments that have a thread pattern facing and selectively engaging with a thread 92 on the inner mandrel 32. The automatic nut 90 is a ratchet type device such that when the inner mandrel 32 is rotated to the right, the segments of the automatic nut 90 simply ratchet over the thread 92. However, if the inner mandrel 32 is rotated to the left, the automatic nut 90 engages the threads 92. The top sub 82 and sub 58, being constrained by the key 78 from rotation, and wind up moving axially so that the o-ring seals 54 and 56 no longer straddle ports 52 (now shown in the open position in FIG. 4). Simply setting down weight on the inner mandrel 32 will reclose the ports 52 in the event of a well kick.

In order to set the slips 66 and the seal 48, weight is set down during deployment so that the castellations 94 engage the castellations 38 and the drive sub 34 is turned to the right about 40 degrees. Using a combination lock/j-slot mechanism 96, these movements enable, upon subsequent application of pick-up force, movement of the cone 64 under the slips 66. Continued pulling force compresses the seal 48 against the surrounding tubular to be cut. At this point, the relative motion between the outer mandrel 59 and the cone 64 are selectively locked. By turning inner mandrel 32 to the right while picking up, the tensile force on inner mandrel 32 can be maintained when cutting. By picking up and turning inner mandrel 32 to the left, the ports 52 can be opened before cutting. When ports 52 are open, the automatic nut 90 is no longer affected by right-hand rotation of inner mandrel 32. In the event of a well kick, the ports 52 are closed by setting down weight, but the slips 66 and the seal 48 remain set even with the weight being applied. Eventually, the slips 66 and seal 48 can be released by a set-down force that will pull the cone 64 out from under the slips 66 allowing the seal 48 to grow axially while retracting radially. The spear S can be reset in other locations inside the surrounding tubular any number of times and at any number of locations.

Figure 1:
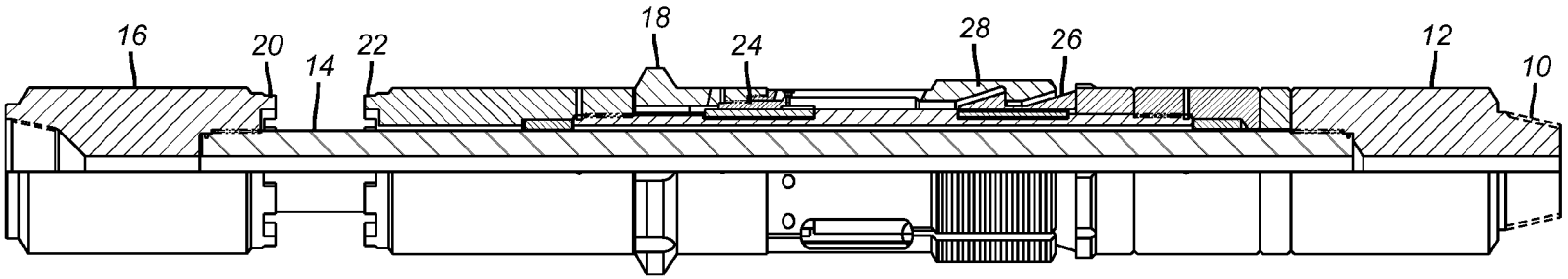
(PRIOR ART) FIG. 1
FIG. 1 is a prior art spear design that uses a stop ring to land on the fish.
Figure 2:
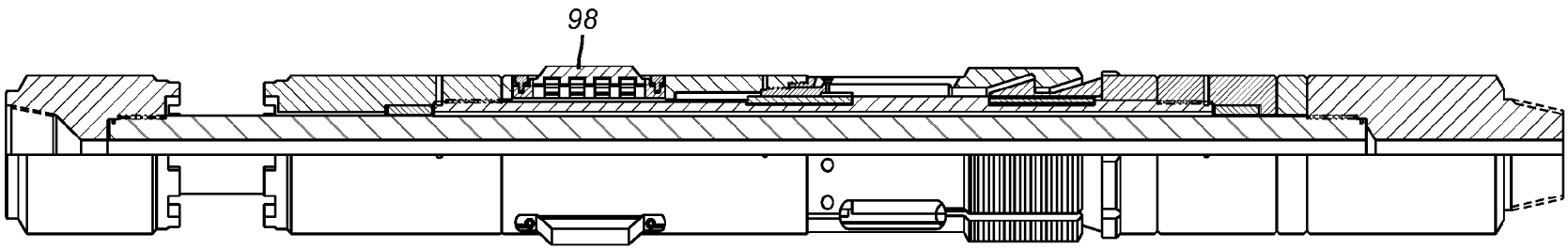
FIG. 2 is a multi-setting spear that is mechanically set to allow multiple cuts in a single trip.

It should be noted that in FIG. 2, the seal 48 is not used and neither is the annular space 50. In this configuration, a single row of drag blocks 98 is used. The other operations remain the same.

Those skilled in the art will appreciate that the spear S offers several unique and independent advantages. It allows for setting and cutting (in tension) at multiple locations within the tubular, while retaining an ability to circulate through the inner mandrel 32 to power the cutter C and/or to remove cuttings. The tool has the facility to filter cuttings and prevent them from reaching a blowout preventer where they could cause damage. In the FIGS. 3 and 4 configuration, the cuttings can be filtered using the screen 46 leading to the ports 44, with the seal 48 set so that the return flow is fully directed to the screen 46. In another embodiment, such as FIG. 2, a junk or debris catcher can be incorporated at the lower end. Such a device would likely have a flow diverter to direct cuttings into the device where they could be retained and screened. The clean fluid could be returned to the annular space above the diverter for the trip to the surface. Another advantage of the spear S is the ability to have the annulus selectively sealed with seal 48. Doing so gives the functionality of closing the bypass 50 quickly to mitigate the effects of a well kick. In this embodiment, closing the ports 52 is accomplished by applying set-down weight. Note that not all jobs will require the bypass 50 around the seal 48 to be open during the cutting.

FIGS. 5-16 illustrate an alternative and preferred embodiment of the present invention. The tool is broken down into 11 sections sequentially numbered in FIG. 5*a*-5*b*. Section 1 is a j-slot assembly 203 that interacts with the top sub 201 by selective engagement of pins 250 in slot 252. Section 2 moves with section 1 and is a sleeve 206 that can be raised to move spaced seals 254 and 256 away from port 258 in sleeve 209. Section 3 is a housing for drag blocks 212 and has an internal travel stop 260 on cam 215 that has to be cleared by rotating cam 215. As sections 1 and 2 are rotated with a surface string (not shown), the drag blocks 212 hold section 3 stationary. This is shown in more detail in FIG. 8. Section 4 is the housing for the locking dogs 216 (shown in more detail in FIG. 6) that can spring out into groove 262 to lock the set position of the slips 220 and the seal 223, 225, and 226. Sections 5 and 6 are respectively the housings for the slips 220 and the seals 223, 225, and 226. Section 7 contains the inlet for fluid bypass and a screen 227 that allows fluid to bypass the seals 223, 225, and 226 and enter the upper annulus when port 258 is actuated open in section 2. Section 8 is the housing for the stack of disc springs 229 that get compressed when a pick-up force is applied at top sub 201, allowing the dogs 216 to be pushed out of groove 262 by sleeve 219. This can be better seen by comparing FIGS. 11 and 14. Section 9 is a roller bearing housing for bearing 205. Section 10 allows an emergency release by dropping a ball 264 that, when pressure is applied, shifts seat 232 to expose ports 266 to compress the disc springs 229 and release the dogs 216. This is shown in FIG. 13*b*. Finally, section 11 is a thrust bearing 233 which facilitates the rotation of the bottom sub 234 against the stationary piston chamber 231.

Figure 8:
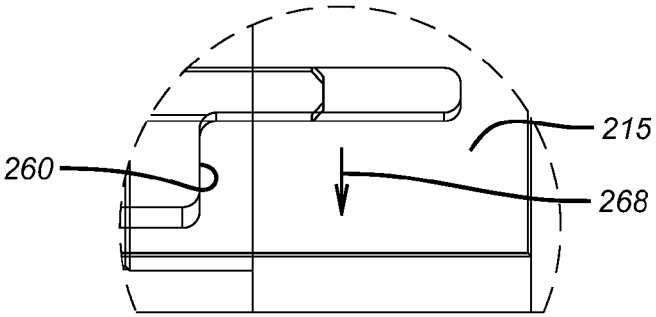
FIG. 8 shows a cam arrangement that, during cut-and-pull spear deployment, prevents pick-up action from setting the slips and seal until rotation defeats the cam arrangement.
Figure 9A:
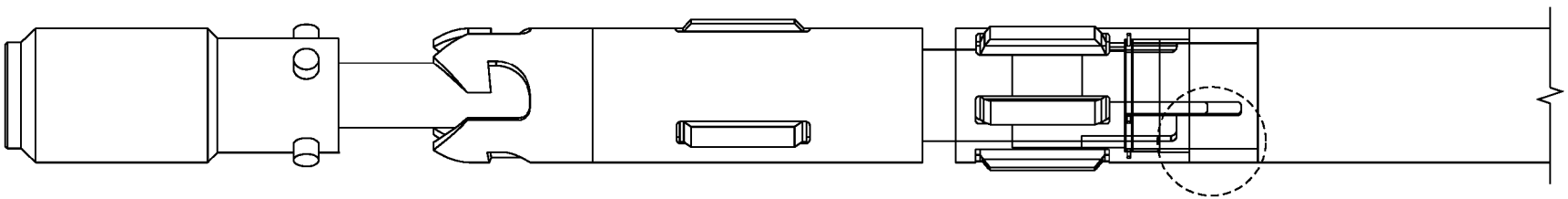
FIG. 9*a*-9*b* is a view of FIG. 5*a*-5*b* with a pick-up and rotation to allow the slips and seal to set.
Figure 9B:
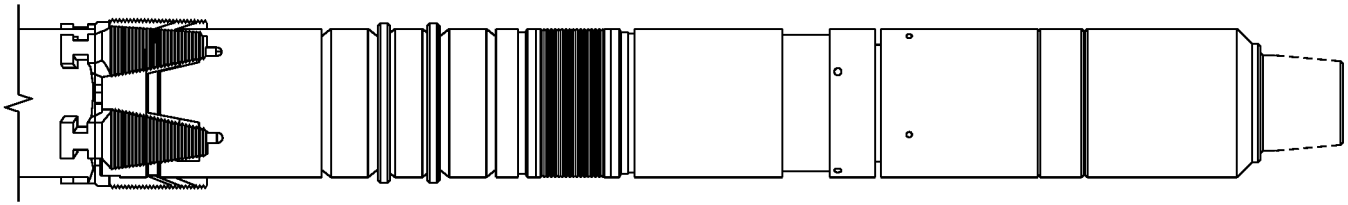
Figure 10A:
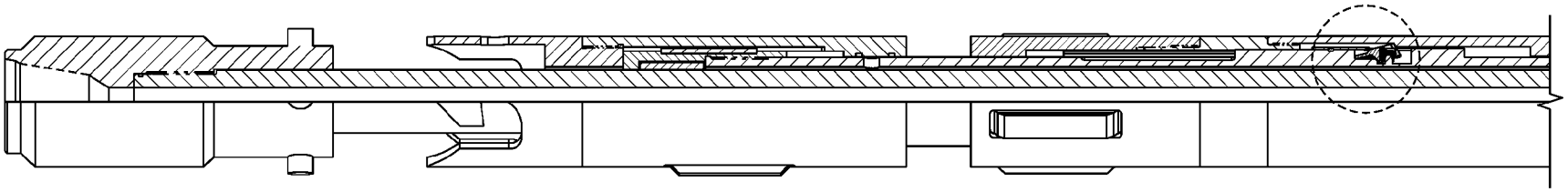
FIG. 10*a*-10*b* is a view of FIG. 9*a*-9*b* with additional pick-up to set the slips and seal.
Figure 11:
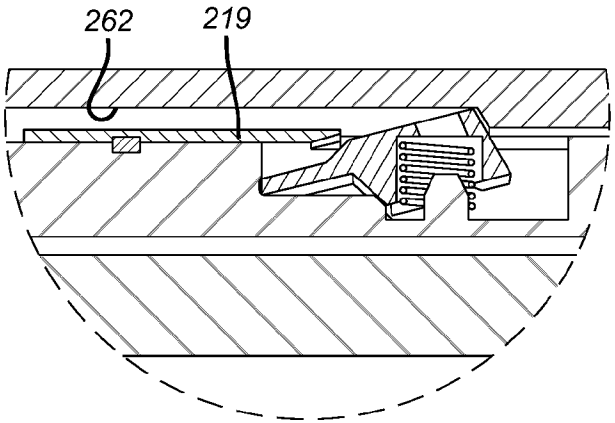
FIG. 11 shows the lock extended with the slips and seal set, as in FIG. 10*a*-10*b;*
Figure 10B:
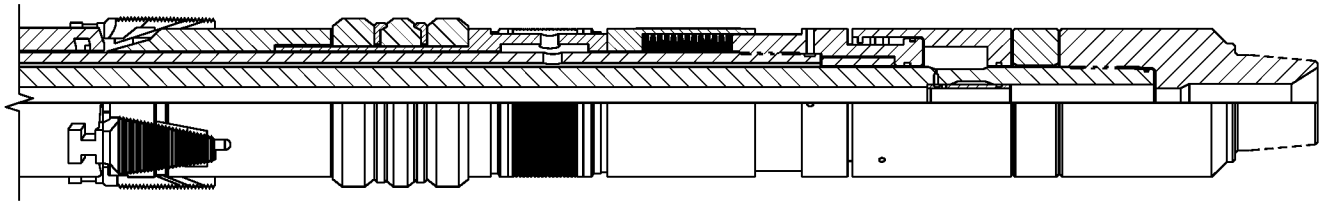
Figure 12A:
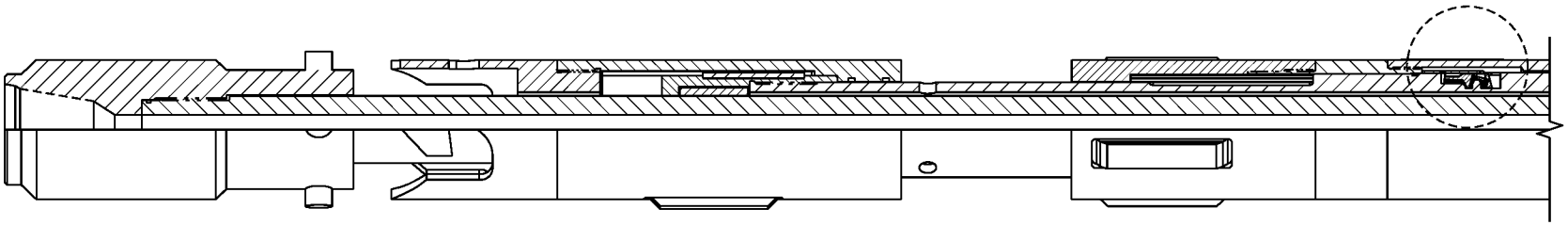
FIG. 12*a*-12*b* shows the use of overpull to compress the disc springs and allow subsequent release of the seal and slips by setting down weight.

The tool is designed so the drag blocks 211 on section 3 will drag inside the casing to be cut. The drag blocks hold section 3 in place so the outer mandrel 209 can be rotated a ¼ turn. Setting down weight on the top sub 201 will align the top sub lugs 250 with the axial portion of the groove 252 in j-slot sub 203. Right-hand rotation from the top sub 201 is transferred into j-slot sub 203 which is attached to the circulation sub 206. The circulation sub 206 is rotationally locked to the outer mandrel 209. Outer mandrel 209 has a cam 215 (shown in enlarged detail in FIG. 8) which is also rotationally locked to outer mandrel 209. Right-hand rotation causes the cam 215 to rotate while the lug sub 214, which is attached to the drag sub 210, does not move because the drag block 211 rubs on the (unshown) surrounding tubular. With the lug sub 214 aligned with the cam 215 after rotation of cam 215 in the direction of arrow 268, the outer mandrel 209 is allowed to move up because surface 260 no longer acts as a travel stop for lug sub 214. This is shown in FIG. 8. When the outer mandrel 209 moves up and thrust bearing 233 contacts piston housing 231, the components below the slip 220 will start to move up while components above the slip 220 stay in place because of the upper and lower drag blocks 211. Once the slip 220 is supported by the cone 221, continued pull-up will set the slip 220 in the casing (not shown) and cause the packing elements 223-226 to set. Additional pull-up will compress the disc springs 229 enough to let the locking dog 216 open (as shown by comparing FIGS. 6 and 11). With the locking dog 216 in the open position, the tool is locked in position and force can be applied in compression and tension without fear of release of the slips 220 or the seal assembly 223-226. This can be useful if jars (not shown) are deployed above the tubing cutter and need to be re-cocked by setting down weight.

Moving the inner mandrel section 201, 202, and 234 up causes the thrust bearing 233 to come in contact with the piston housing 231, and continuous rotation to the right with tension allows the use of a cutter C below to cut casing. The circulation/latch section 206, 258 can be opened, if needed, by lowering the inner mandrel section 201, 202, and 234 into the j-slot 203, rotating left ¼ turn, and lifting up (see FIG. 12*a*-12*b*). With the circulation sub 206, 258 open, fluids can be circulated back to the surface by bypassing the set seal assembly 223-225 through screen 227 where debris from the cut is filtered.

Figure 17:
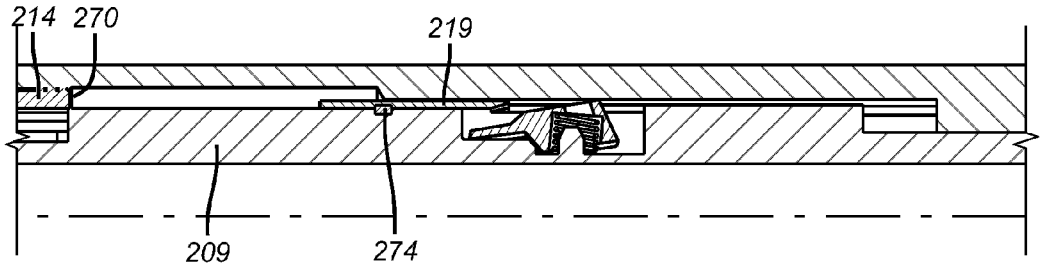
FIG. 17 is a detailed view of the lock in the run-in position before the slips and seal are actuated.
Figure 18:
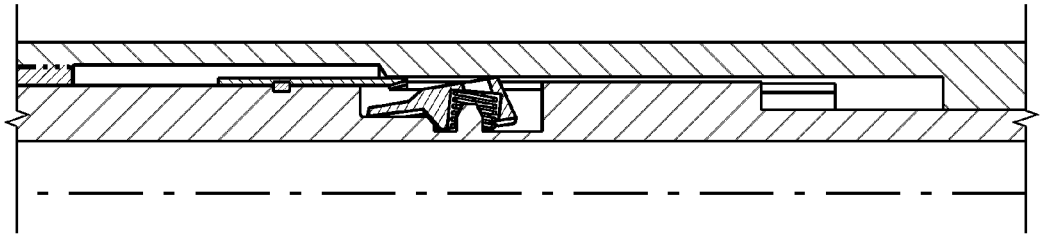
FIG. 18 is a view of FIG. 17 as a dog moves in unison with a sleeve during the process of the slips and seal being set.
Figure 19:
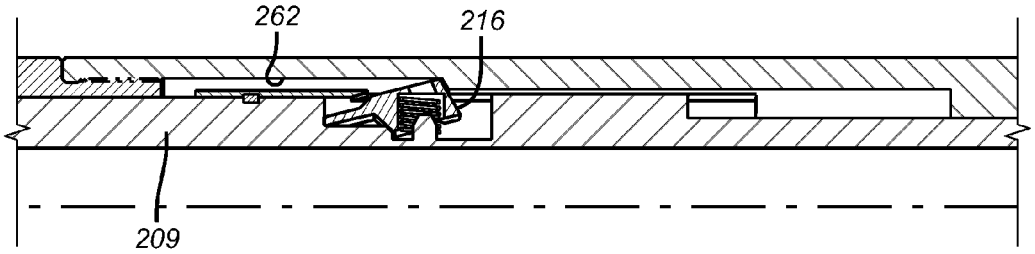
FIG. 19 is a view of FIG. 18 with the slips and seal set and the dog extended into a deeper groove to hold their set.
Figure 20:
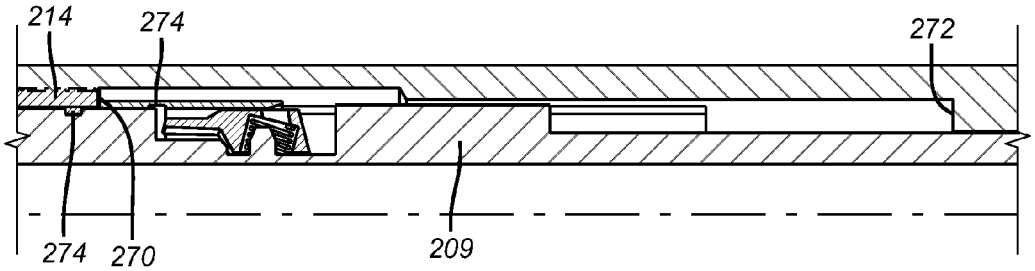
FIG. 20 is a view of FIG. 19 showing the pick-up force that compresses the disc springs and the sleeve shouldered out so it can push in the dog to allow release on set-down.
Figure 21:
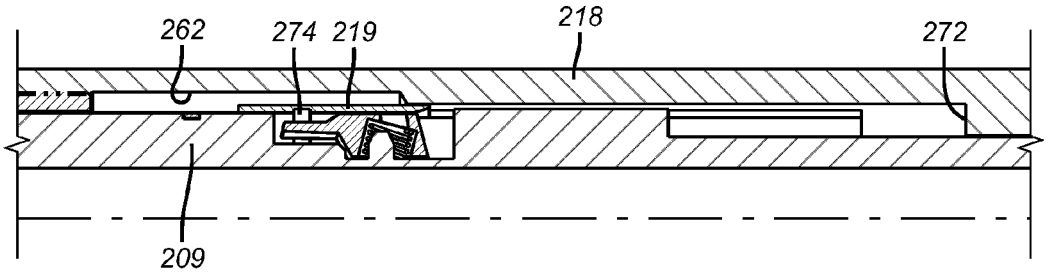
FIG. 21 is a view of FIG. 20 showing the lock held retracted as the weight is set down to release the slips and the seal.
Figure 22:
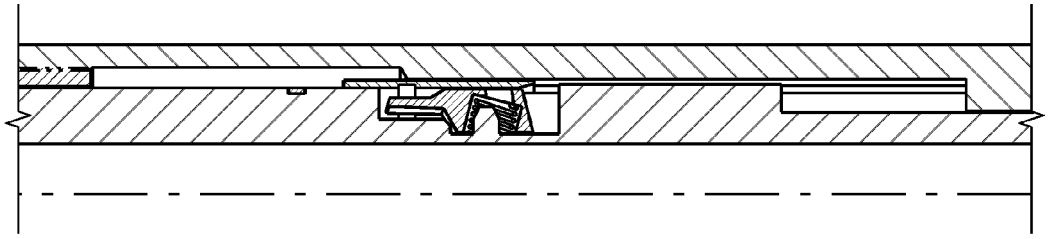
FIG. 22 is a view of FIG. 21 showing the retaining sleeve shouldered out as weight is set down.
Figure 23:
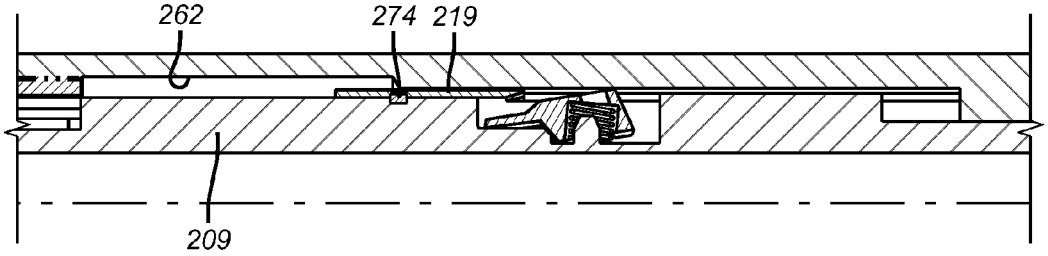
FIG. 23 is a view of FIG. 22 showing the separation of the lock and the sleeve and the resumption of the run-in position for possible repositioning in the wellbore or removal of the associated tool.

To release the tool, the locking dog 216 has to be relaxed. This is accomplished with overpull to overcome the disc springs 229. The dog sleeve 219 (see FIGS. 6, 11, and 14) stops when it hits the shoulder 270 (see FIG. 20) of the lug sub 214. However, the dog 216 and outer mandrel 209 will continue up. This continued movement will cause the dog 216 to collapse under the dog sleeve 219. When the inner mandrel section 201, 202, and 234 is moved down, it contacts the circulation j-slot 203 which moves down and contacts the outer mandrel top sub 204, moving the outer mandrel 209 down, with the dog 216 trapped under the dog sleeve 219, thus allowing the dog 216 to pass the groove 262 (compare FIGS. 20-23). The outer mandrel section 206 will continue down until the circulation port 258 is closed. While the outer mandrel section 206 is moving down, the dog sleeve 219 will bottom out on the internal shoulder 272 of the dog housing 218. This will let the locking dog 216 come out from under the dog sleeve 219 and be ready to come out into groove 262 when the tool is set again (see FIG. 23). Referring to FIGS. 17-23, one can see that in the run-in position of FIG. 17, the sleeve 219 is releasably secured to the outer mandrel 209 by a first lock 274 that can be a spring-loaded sphere or a cammed c-ring or some other structure that retains parts together up to a predetermined applied force and then releases. Other structures can be a disc spring or a stack thereof. As a pick-up force is applied to set the slips 220, the sleeve 219 is still retained by the first lock 274 for tandem movement with outer mandrel 209, so that the dog 216 can be sprung out into groove 262 to hold the set of the slips and the seal. When section 201, 202, and 234 is further raised up for a release of the slips and seal by compressing the disc spring stack 229, the sleeve 219 hits stop 270 (see FIG. 20) and the dogs 216 are pushed under sleeve 219 and out of groove 262. In the course of that action, the spring-loaded ball first lock 274, or equivalent, releases its grip (shown schematically in FIG. 20). In FIG. 21, the sleeve 219 now moves in tandem with outer mandrel 209 because a second lock (not shown) holds them together until the sleeve engages internal shoulder 272. At this point, the dogs 216 have moved below the groove 262, and further downward movement of the dogs 216 occurs relative to the sleeve 219 which is stopped by internal shoulder 272. As a result, the dogs 216 again can be biased outward while spaced apart from the sleeve 219 as first lock 274 again selectively attaches sleeve 219 to outer mandrel 209 (shown in FIG. 23). FIG. 23 and the run-in position of FIG. 17 are the same.

The lock system in FIGS. 17-23 can be used for a variety of tools that are resettable downhole. The advantages are that the lock sets and unsets with an axial force, without the need for rotation. It employs a surface signal of overpull, such as the compression of the disc spring stack, to retract the dog under the shifting dog sleeve and hold it retracted as axial movement allows the dog to be shifted clear of the locking grove. Further axial movement allows the dogs to again resume the run-in position for the next engagement of the tool into the set position. As a result, picking up will set the tool and selectively lock it. Further picking-up with a surface signal releases the lock. Subsequent downward axial movement will reset the lock into the initial free position. The further picking up can be accomplished by a pulling force from the surface or by an alternative release, such as by dropping a ball on a seat and pressuring a piston to create the axial movement (as will be explained below). Those skilled in the art will appreciate that the axial trigger movements can also be reversed or can be a combination of up and down movements. The fact that there is no rotation is a plus, especially in deviated wellbores. The selectively locking-in of the set allows other operations, such as the delivery of jarring blows, to take place without fear of losing the set position.

Figure 24:
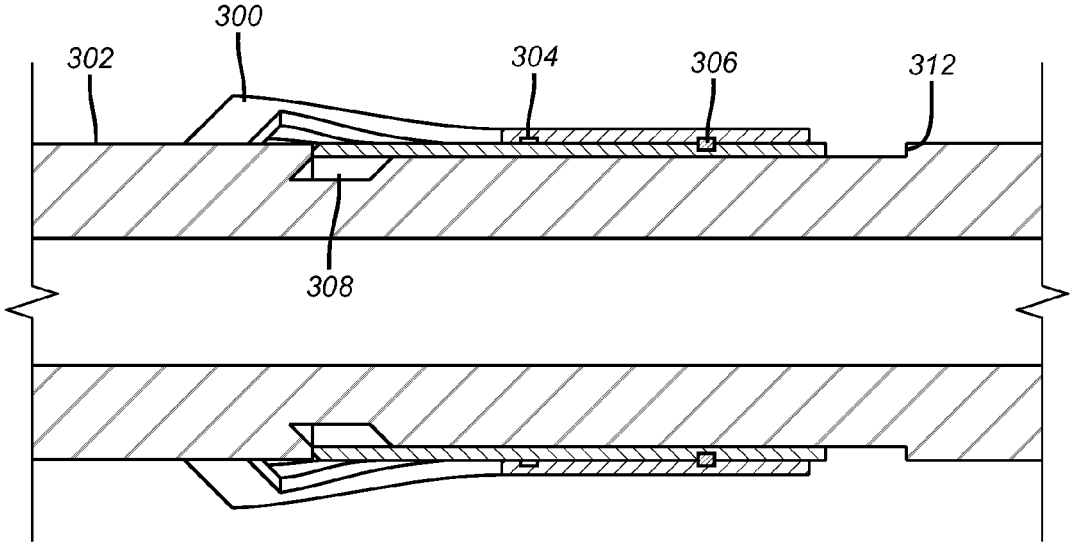
FIG. 24 is an alternative lock embodiment in the run-in position.
Figure 25:
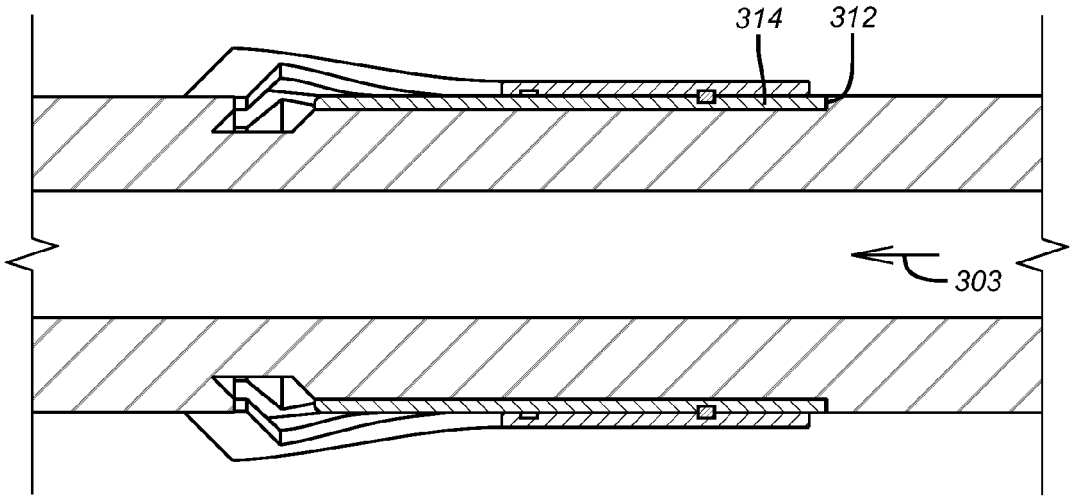
FIG. 25 is the lock of FIG. 24 with a lower end of a sleeve contacting a mandrel shoulder.
Figure 26:
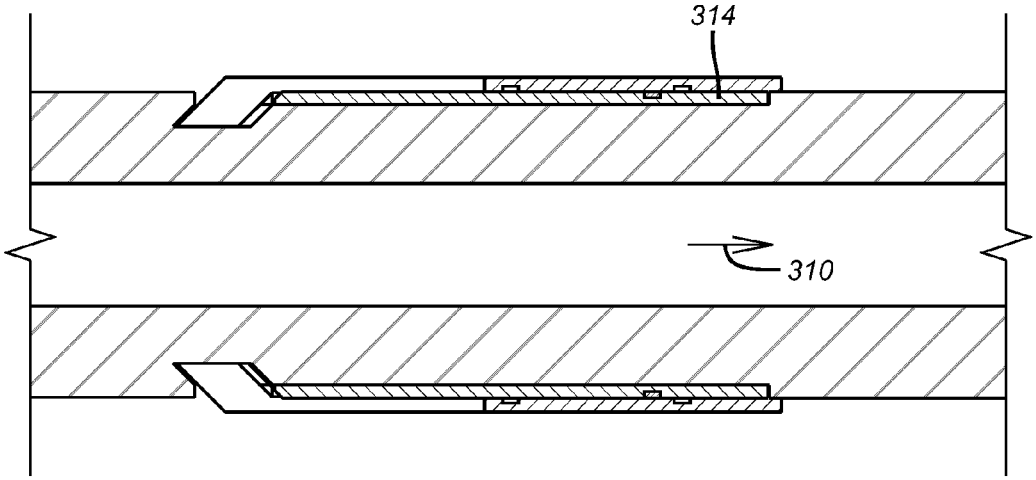
FIG. 26 is the lock of FIG. 25 in a locked position, with a collet engaging a groove in a mandrel.
Figure 27:
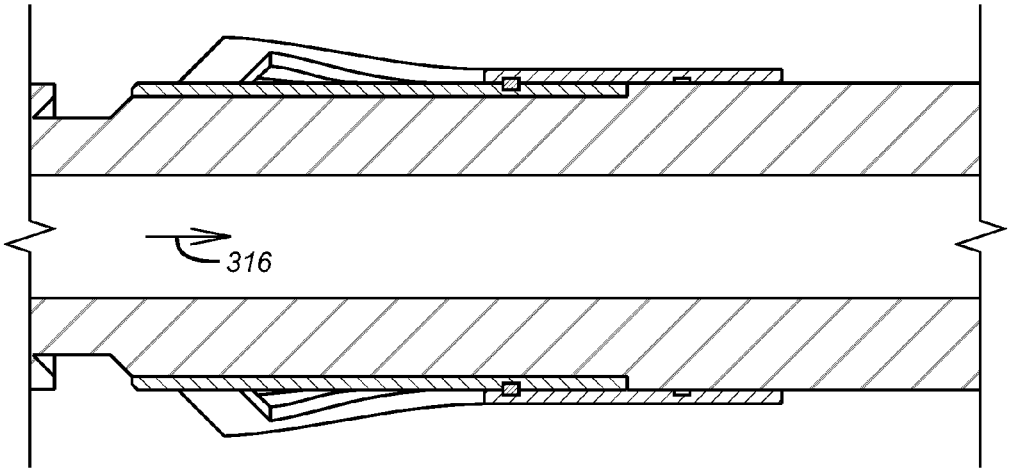
FIG. 27 is the lock of FIG. 26 with the collet out of the groove and selectively attached to the sleeve.
Figure 28:
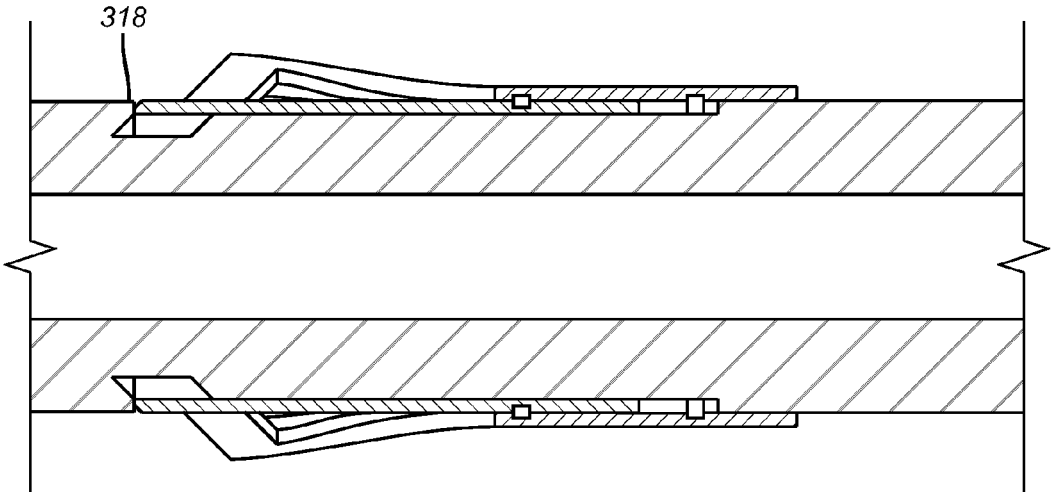
FIG. 28 is the lock of FIG. 27 with the upper end of the sleeve contacting a second mandrel shoulder as the collet, mounted on the sleeve, moves past the groove in the mandrel.
Figure 29:
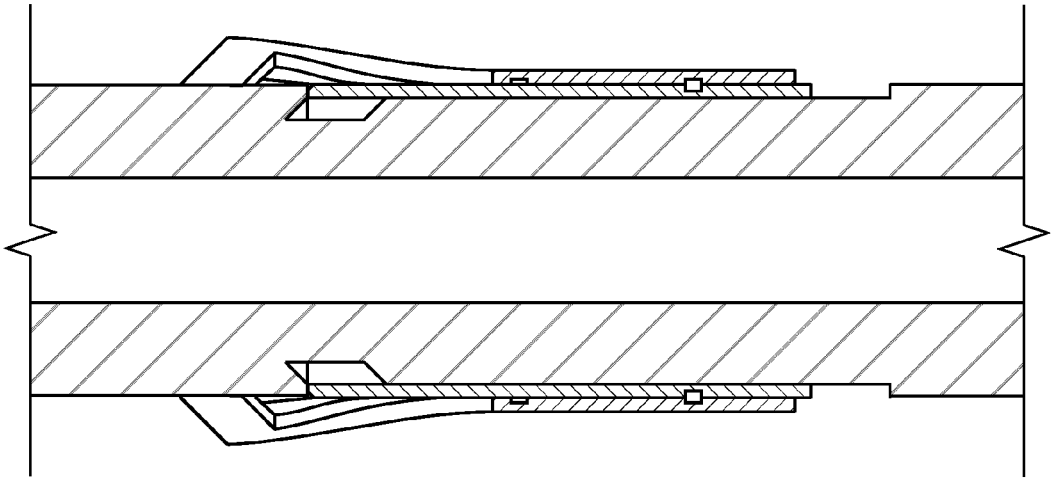
FIG. 29 is the lock of FIG. 28 reconfigured in the run-in position of FIG. 24.

The same resettable locking mechanism can be achieved through the use of a collet in place of dogs, as shown in FIGS. 24-29. In FIG. 24, a collet 300, mounted to a stationary component that is not shown, is supported in a pre-bent state by a movable component 302, such as the outer mandrel of the cut-and-pull spear, and is held to a sliding sleeve 314 by one of two selective locks 304 or 306. In FIG. 24, which is the run-in position, the lock 306 holds the sleeve 314 to the collet 300. When the moveable component 302 is pulled in the direction of arrow 303 (as to set the slips and seal), the collet 300 snaps into a groove 308 in the moveable component 302, as shown in FIG. 26, and prevents movable component 302 movement in the reverse direction as indicated by arrow 310. This is the locked position of the anchor and is shown in FIG. 26. Further pulling of the moveable component 302 in the direction of arrow 303 shoulders the sliding sleeve 314 against the moveable component 302 at shoulder 312, thereby releasing the first selective lock 306 between the collet 300 and the sliding sleeve 314. The movement also allows the collet 300 to move out of the groove 308 and onto the sliding sleeve 314, engaging a second selective lock 304 to secure sleeve 314 to the collet 300. This movement requires a certain threshold of force due to the bending of the collet 300, which serves as the surface signal that the lock has been overcome.

Pushing the moveable component 302 in the direction of arrow 316 then allows the collet 300 to return to the FIG. 24 position, because the collet 300 remains mounted on sleeve 314 until the sleeve 314 engages groove 308 at surface 318. At that point the lock 306 again secures the sleeve 314 to the collet 300. Continuing movement of the movable member 302 then returns the collet 300 to the run-in position shown in FIG. 24, which is the same as FIG. 29. The process can be repeated to again lock the collet 300 to the moveable component 302. The described configuration can be easily reversed so that the collet 300 is supported by the stationary part, which is not shown, and mounted to the moveable component 302.

Continuing now with the release procedure for the tubular cutter C, continued push-down with the inner mandrel section 201, 202, and 234 without the dog 216 catching on the slip housing 218 will allow the slip 220 and packing elements 223-225 to relax, and the tool can be moved up and down the casing, as needed. For the tool to move up freely, the inner mandrel section 201, 202, and 234 will need to be rotated ¼ turn to the left while pushing down to re-engage the cam 215 with the lug sub 214 (as shown in FIG. 8, which is the view before the ¼ turn of rotation).

Figure 13A:
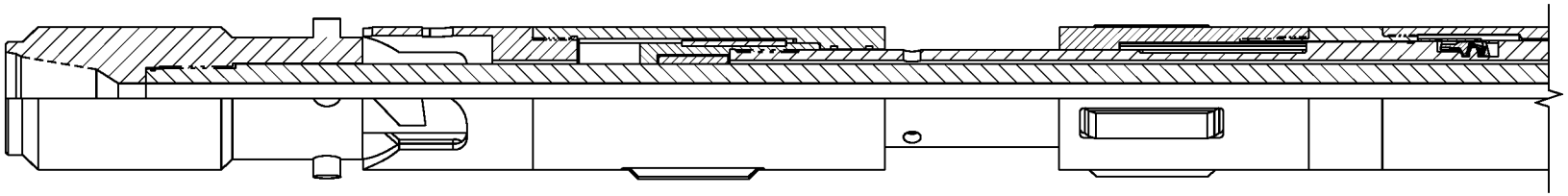
FIG. 13*a*-13*b* shows an emergency release by dropping a ball to use pressure to compress the disc springs so as to get the lock to release, so the seal and slips can be released with a set-down weight.
Figure 12B:
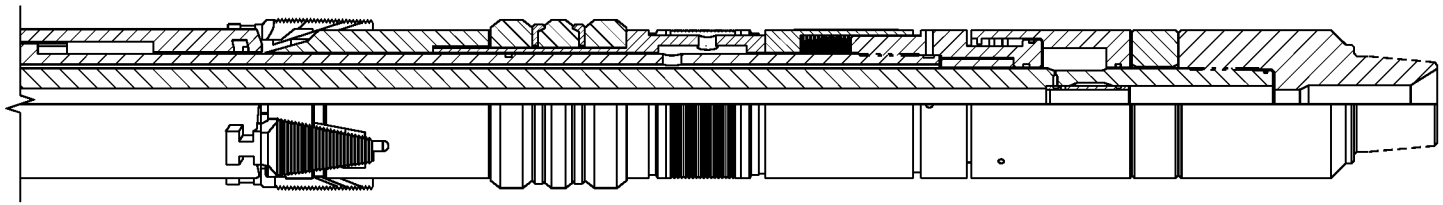
Figure 13B:
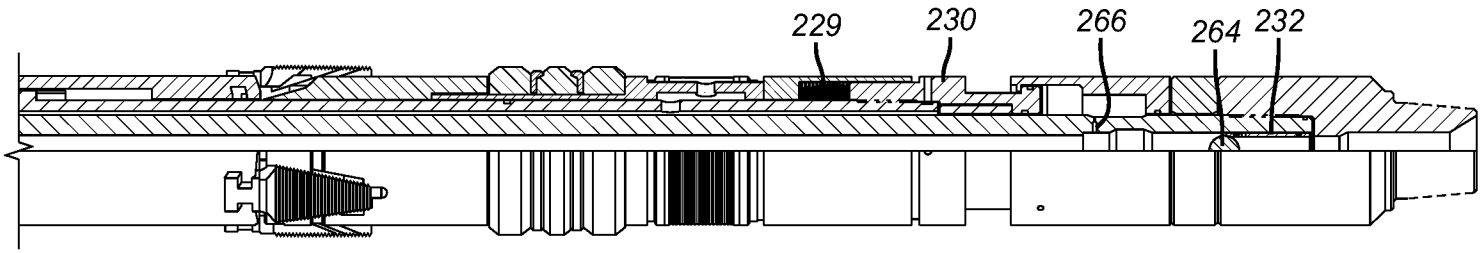
Figure 14:
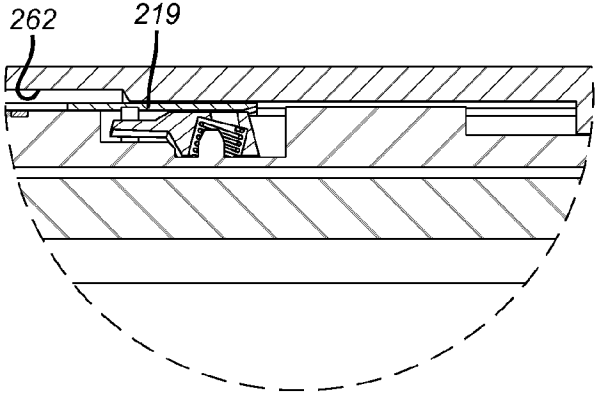
FIG. 14 shows the lock retracted with a sleeve as a result of compression of the disc springs shown in FIG. 12*a*-12*b* or 13*a*-13*b;*
Figure 15A:
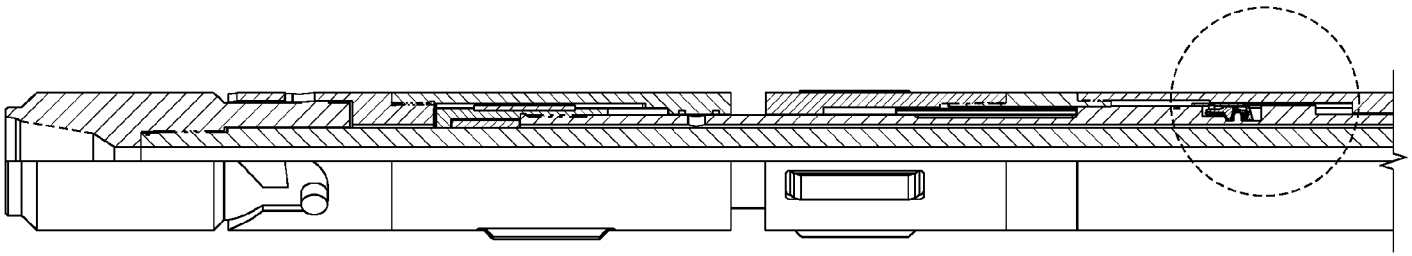
FIG. 15*a*-15*b* is a set-down view with the slips and seal released just before a rotation locks the release position to allow cut-and-pull spear assembly movement and a resetting without the possibility of actuation while moving.
Figure 16:
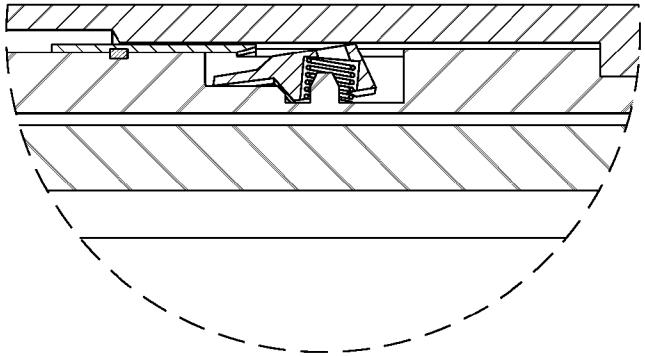
FIG. 16 shows the lock back to the run-in position when redeploying the assembly to another location in the same trip.
Figure 15B:
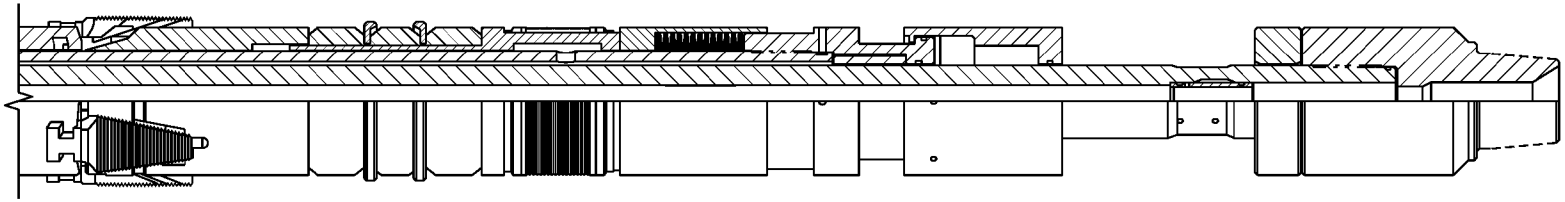

FIG. **13*a*-13*b* shows a secondary release method to release at surface or to release in the event that applying a pulling force followed by setting down fails to release the slips 220. Shown in FIG. 13*a*-13*b* is a ball 264 landing on seat 232. This figure also shows the seat 232 in a position after it has been shifted to expose port 266. Applied pressure then reaches the piston 230 which then compresses the disc springs 229, thus simulating the same effect as a pick-up force on the string. The dogs 216** will be retracted so that a subsequent set-down force will extend the slips and seal assembly for a release. Subsequently, a ¼ turn left will re-latch the tool so that it will not re-engage the surrounding tubular as it is repositioned for another cut or removed from the wellbore.

The above description is illustrative of the preferred embodiment and many modifications may be made by those skilled in the art without departing from the invention whose scope is to be determined from the literal and equivalent scope of the claims below.

We claim:

1. A spear and tubular cutter combination, comprising:

a mandrel rotatably mounted in an outer assembly for multiple revolutions, said mandrel supporting a tubular cutter and having a flow passage therethrough that remains open for fluid flow as said mandrel rotates said tubular cutter at a speed required to complete the cutting of a tubular;

an anchor mounted to said outer assembly and configured to allow said outer assembly to enter the tubular for multiple deployments and releases of said anchor with respect to the tubular with said deployments and releases completed in a single trip;

a selectively releasable lock that automatically actuates to hold said anchor in a set position and releases without rotation of said mandrel, said multiple revolutions occurring with said anchor in a fully set position and putting the portion of the tubular that is uphole from the cut in tension through said mandrel.

2. The combination of claim 1, wherein:

said lock engages with axial movement of said mandrel.

3. The combination of claim 1, wherein:

said lock releases with axial movement of said mandrel.

4. The combination of claim 1, further comprising:

a sealing element assembly that sets against the tubular when said anchor is set, said multiple revolutions occurring when said sealing element is fully set; and wherein said cutter cuts the tubular with a tensile force on the tubular applied through said mandrel.

5. The combination of claim 4, wherein:

said anchor and sealing element assembly are prevented from setting when said mandrel is moved axially until said mandrel is rotated.

6. The combination of claim 4, wherein:

said outer assembly comprises a selectively operated bypass passage around said sealing element assembly.

7. The combination of claim 6, wherein:

said bypass passage further comprises a screen.

8. The combination of claim 6, wherein:

said bypass passage selectively opens or closes when said anchor is set with movement of said mandrel;

said bypass passage is open as said mandrel rotates said tubular cutter.

9. The combination of claim 1, wherein:

said selectively releasable lock is locked by initial relative movement that allows a collet to enter a groove on said anchor to prevent relative movement in a second direction opposed to said initial relative movement.

10. The combination of claim 9, wherein:

continuation of said initial relative movement with a predetermined force shifts said collet from said groove.

11. The combination of claim 10, wherein:

upon exiting said groove, said collet mounts a sleeve, which prevents said collet from re-entering said groove upon relative movement in said second direction.

12. The combination of claim 11, wherein:

said sleeve engages a travel stop after said groove travels past said collet.

13. The combination of claim 12, wherein:

said sleeve is initially releasably secured to said collet with a first locking member, and said initial relative movement releases said sleeve from said collet and allows said collet to engage said groove;

said initial relative movement occurs by movement of a movable member with respect to said collet, said movable member comprising a shoulder to engage said sleeve to then release said first locking member;

when said collet moves out of said groove as said initial relative movement continues, said sleeve is locked to said collet by a second locking member.

14. The combination of claim 13, wherein:

said second locking member is defeated during said second relative movement after said groove travels past said collet while said collet is mounted on said sleeve;

said movable member then brings said travel stop against said sleeve to allow said first locking member to reconnect said sleeve to said collet so that said selectively releaseable lock is again ready for another cycle.

15. A spear and tubular cutter combination, comprising:

a mandrel rotatably mounted in an outer assembly, said mandrel supporting a tubular cutter and having a flow passage therethrough that remains open for fluid flow as said mandrel rotates said tubular cutter;

an anchor mounted to said outer assembly and configured to allow said outer assembly to enter a tubular for multiple deployments and releases of said anchor with respect to the tubular with said deployments and releases completed in a single trip;

a selectively releasable lock that automatically actuates to hold said anchor in a set position;

said lock releases with pressure applied to an object that selectively blocks said passage.

16. The combination of claim 15, wherein:

said lock comprises at least one dog mounted to a movable member of said outer assembly for selective engagement of said dog to a groove in a surrounding housing retained by said anchor.

17. The combination of claim 16, wherein:

said lock comprises a sleeve slidably mounted to said movable member to selectively overlap said dog to retract said dog from said groove.

18. The combination of claim 17, wherein:

said sleeve moves in tandem with said movable member until contacting at least one travel stop in at least one direction of sleeve movement, whereupon said movable member and said dog move with respect to said sleeve.

19. The combination of claim 18, wherein:

said sleeve is selectively held to said movable member with a releasable lock that is defeated when said sleeve hits said travel stop and said movable member and dog continue axial movement.

20. The combination of claim 19, wherein:

said sleeve is initially retained in an offset relation to said dog while being selectively retained to said movable member to allow said dog to be biased into said groove upon alignment of said dog with said groove when axial mandrel movement sets said anchor and sealing element assembly, said dog locking the set of said anchor and sealing element assembly.

21. The combination of claim 20, wherein:

further axial mandrel movement to release said anchor and said sealing element assembly requires an enhanced force as a surface signal that release is imminent.

22. The combination of claim 21, wherein:

said further mandrel movement overcomes a spring force and causes said sleeve to contact said travel stop to overcome said releasable lock and subsequent contact by said dog of now stationary said sleeve pushes said dog out of said groove for release of said anchor and sealing element assembly.

23. The combination of claim 22, wherein:

said dog remains contained within said sleeve to allow said dog to be axially shifted without engaging said groove, whereupon said sleeve engages a second travel stop and is retracted from said dog and retained to said movable member by said releasable lock.

24. A spear and tubular cutter combination, comprising:

a mandrel rotatably mounted in an outer assembly, said mandrel supporting a tubular cutter and having a flow passage therethrough that remains open for fluid flow as said mandrel rotates said tubular cutter;

an anchor mounted to said outer assembly and configured to allow said outer assembly to enter a tubular for multiple deployments and releases of said anchor with respect to the tubular with said deployments and releases completed in a single trip;

a selectively releasable lock that automatically actuates to hold said anchor in a set position;

said lock comprises at least one dog mounted to a movable member of said outer assembly for selective engagement of said dog to a groove in a surrounding housing retained by said anchor.

25. The combination of claim 24, wherein:

said lock comprises a sleeve slidably mounted to said movable member to selectively overlap said dog to retract said dog from said groove.

26. The combination of claim 25, wherein:

said sleeve moves in tandem with said movable member until contacting at least one travel stop in at least one direction of sleeve movement, whereupon said movable member and said dog move with respect to said sleeve.

27. The combination of claim 26, wherein:

said sleeve is selectively held to said movable member with a releasable lock that is defeated when said sleeve hits said travel stop and said movable member and dog continue axial movement.

28. The combination of claim 27, wherein:

said sleeve is initially retained in an offset relation to said dog while being selectively retained to said movable member to allow said dog to be biased into said groove upon alignment of said dog with said groove when axial mandrel movement sets said anchor and sealing element assembly, said dog locking the set of said anchor and sealing element assembly.

29. The combination of claim 28, wherein:

further axial mandrel movement to release said anchor and said sealing element assembly requires an enhanced force as a surface signal that release is imminent.

30. The combination of claim 29, wherein:

said further mandrel movement overcomes a spring force and causes said sleeve to contact said travel stop to overcome said releasable lock and subsequent contact by said dog of now stationary said sleeve pushes said dog out of said groove for release of said anchor and sealing element assembly.

31. The combination of claim 30, wherein:

said dog remains contained within said sleeve to allow said dog to be axially shifted without engaging said groove, whereupon said sleeve engages a second travel stop and is retracted from said dog and retained to said movable member by said releasable lock.

32. A spear and tubular cutter combination, comprising:

a mandrel rotatably mounted in an outer assembly for multiple revolutions, said mandrel supporting a tubular cutter and having a flow passage therethrough that remains open for fluid flow as said mandrel rotates said tubular cutter at a speed required to complete the cutting of a tubular;

an anchor mounted to said outer assembly and configured to allow said outer assembly to enter the tubular for multiple deployments and releases of said anchor with respect to the tubular with said deployments and releases completed in a single trip;

a selectively releasable lock that automatically actuates to hold said anchor in a set position and releases without rotation of said mandrel, said multiple revolutions occurring with said anchor in a fully set position;

said lock is set by initial axial movement of said mandrel and is released with further axial movement in the same direction.

33. A spear and tubular cutter combination, comprising:

a mandrel rotatably mounted in an outer assembly, said mandrel supporting a tubular cutter and having a flow passage therethrough that remains open for fluid flow as said mandrel rotates said tubular cutter;

an anchor mounted to said outer assembly and configured to allow said outer assembly to enter a tubular for multiple deployments and releases of said anchor with respect to the tubular with said deployments and releases completed in a single trip;

a selectively releasable lock that automatically actuates to hold said anchor in a set position;

said lock is released with an elevated force that is noticeable at the surface as a signal that release is imminent.

34. The combination of claim 33, wherein:

said elevated force is created when overcoming a spring force with axial mandrel movement or with pressure in said flow passage acting on a piston that overcomes said spring force.

35. A spear and tubular cutter combination, comprising:

a mandrel rotatably mounted in an outer assembly, said mandrel supporting a tubular cutter and having a flow passage therethrough that remains open for fluid flow as said mandrel rotates said tubular cutter at a speed required to complete the cutting of a tubular;

an anchor mounted to said outer assembly and configured to allow said outer assembly to enter the tubular for multiple deployments and releases of said anchor with respect to the tubular with said deployments and releases completed in a single trip;

a selectively releasable lock that automatically actuates to hold said anchor in a set position and releases without rotation of said mandrel;

said lock comprises at least one biased dog that holds the set of said anchor when aligned with a groove in a housing retained by said anchor.

36. A spear and tubular cutter combination, comprising:

a mandrel rotatably mounted in an outer assembly, said mandrel supporting a tubular cutter and having a flow passage therethrough that remains open for fluid flow as said mandrel rotates said tubular cutter;

an anchor mounted to said outer assembly and configured to allow said outer assembly to enter a tubular for multiple deployments and releases of said anchor with respect to the tubular with said deployments and releases completed in a single trip;

a selectively releasable lock that automatically actuates to hold said anchor in a set position;

said lock comprises at least one biased dog that holds the set of said anchor when aligned with a groove in a housing retained by said anchor;

said dog is mounted on a movable component of said outer assembly;

said outer assembly comprises a sleeve slidably mounted on said movable component for positioning said sleeve in an offset relation to said dog to allow said dog to be biased into said groove when aligned with said groove and to allow retraction of said dog from said groove and hold said dog retracted until said dog is no longer aligned with said groove.

37. The combination of claim 36, wherein:

said movable component moves with respect to said sleeve when said sleeve hits at least one travel stop as said movable component and said dog move in at least one axial direction.

38. The combination of claim 37, wherein:

said sleeve moves between opposed travel stops in tandem with said movable component;

said tandem movement occurs with said sleeve either offset from or containing said dog.

* * * * *